US005696875A

United States Patent [19]

Pan et al.

[11] Patent Number: 5,696,875

[45] Date of Patent: Dec. 9, 1997

[54] METHOD AND SYSTEM FOR COMPRESSING A SPEECH SIGNAL USING NONLINEAR PREDICTION

[75] Inventors: Shao Wei Pan, Lake Zurich; Shay-Ping Thomas Wang, Long Grove; Nicholas M. Labun, Chicago, all of Ill.

[73] Assignee: Motorola, Inc., Schaumburg, Ill.

[21] Appl. No.: 550,724

[22] Filed: Oct. 31, 1995

[51] Int. Cl.[6] ..... G10L 9/14

[52] U.S. Cl. ..... 395/2.28; 395/2.1; 395/2.17; 395/2.23; 395/2.71; 395/2.91

[58] Field of Search ..... 395/2.1, 2.17, 395/2.23, 2.28, 2.71, 2.91

[56] References Cited

U.S. PATENT DOCUMENTS 5,557,159 11/1996 Shoham ..... 395/2.15

OTHER PUBLICATIONS

"Voice Processing", Gordon E. Pelton, McGraw-Hill, Inc., pp. 52–67.

"Advances In Speech And Audio Compression", Allen Gersho, Proceedings of the IEEE, vol. 82, No. 6, Jun. 1994, pp. 900–918.

Le et al. "Speech Enhancement Using Non-Linear Prediction." TENCON '93, 1993 IEEE Region 10 Conf. Computer, Communication, 1993.

*Primary Examiner*—Allen R. MacDonald
*Assistant Examiner*—Alphonso A. Collins
*Attorney, Agent, or Firm*—S. Kevin Pickens

[57] ABSTRACT

A speech signal is sampled to form a sequence of speech data. The sequence of speech data is segmented into overlapping segments. Speech coefficients are generated by fitting each segment to a nonlinear predictive coding equation. The nonlinear predictive coding equation includes a linear predictive coding equation with linear terms, and additionally includes at least one cross term that is proportional to a product of two or more of the linear terms. If the segment is voiced, a sinusoidal term is included in the nonlinear predictive coding equation and sinusoidal parameters are generated. Otherwise, a noise term is included in the nonlinear predictive coding equation. The speech coefficients, a voiced bit, and, if the segment is voiced, the sinusoidal parameters are included as compressed speech data.

31 Claims, 2 Drawing Sheets

METHOD AND SYSTEM FOR COMPRESSING A SPEECH SIGNAL USING NONLINEAR PREDICTION

TECHNICAL FIELD

This invention relates generally to speech coding and, more particularly, to speech data compression.

BACKGROUND OF THE INVENTION

It is known in the art to convert speech into digital speech data. This process is often referred to as speech coding. The speech is converted to an analog speech signal with a transducer such as a microphone. The speech signal is periodically sampled and converted to speech data by, for example, an analog to digital converter. The speech data can then be stored by a computer or other digital device. The speech data can also be transferred among computers or other digital devices via a communications medium. As desired, the speech data can be converted back to an analog signal by, for example, a digital to analog converter, to reproduce the speech signal. The reproduced speech signal can then be amplified to a desired level to play back the original speech.

In order to provide a recognizable and quality reproduced speech signal, the speech data must represent the original speech signal as accurately as possible. This typically requires frequent sampling of the speech signal, and thus produces a high volume of speech data which may significantly hinder data storage and transfer operations. For this reason, various methods of speech compression have been employed to reduce the volume of the speech data. As a general rule, however, the greater the compression ratio achieved by such methods, the lower the quality of the speech signal when reproduced. Thus, a more efficient means of compression is desired which achieves both a high compression ratio and a quality of the speech signal.

DESCRIPTION OF THE PREFERRED EMBODIMENT

In a preferred embodiment of the invention, a method and system are provided for compressing a speech signal into compressed speech data. A sampler initially samples the speech signal to form a sequence of speech data. A segmenter then segments the sequence of speech data into at least one subsequence of segmented speech data, called herein a segment. A speech parameter generator generates speech parameters by fitting each segment to a nonlinear predictive coding equation. The nonlinear predictive coding equation includes a linear predictive coding equation having linear terms. In addition to the linear predictive coding equation, the nonlinear predictive coding equation includes at least one cross term that is proportional to a product of two or more of the linear terms. The speech parameters are generated as the compressed speech data for each segment. Inclusion of the cross term provides the advantage of a more accurate speech compression with a minimal addition of compressed speech data.

In a particularly preferred embodiment, a distinction is made between voiced and unvoiced segments. An energy is determined in the segment and compared to an energy threshold. The compressed speech data further includes an energy flag indicating whether the energy is greater than the energy threshold. If the energy is greater than the energy threshold, a sinusoidal term is included in the nonlinear predictive coding equation, and the compressed speech data further includes a sinusoidal coefficient of the sinusoidal term, an amplitude of the sinusoidal term and a frequency of the sinusoidal term. This provides greater accuracy in the speech data for the voiced segment, which requires more description for accurate reproduction of the speech signal than an unvoiced segment. If the energy of the segment is not greater than the energy threshold, a noise term is included in the nonlinear predictive coding equation instead of the sinusoidal term. This provides a sufficiently accurate model of the speech signal for the segment while allowing for greater compression of the speech data. The nonlinear predictive coding equation is used to decompress the compressed speech data when the speech signal is reproduced.

Figure 1:
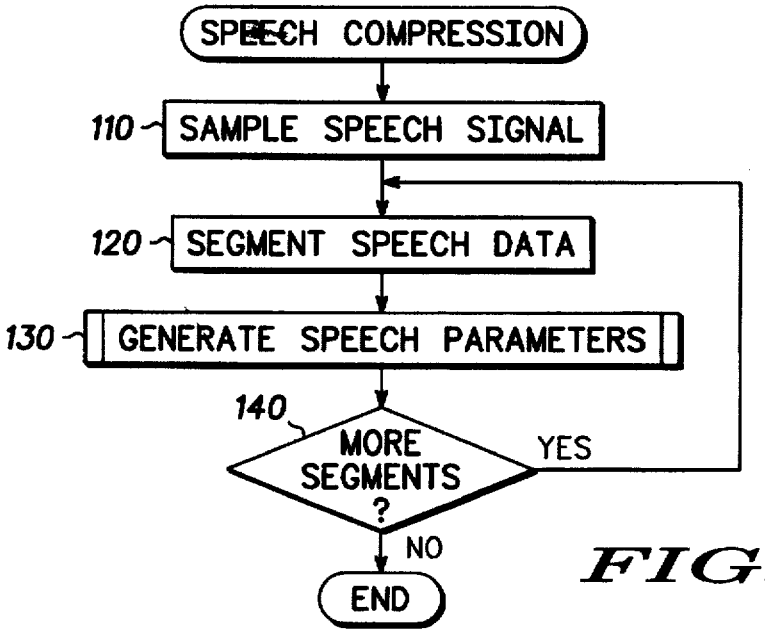
FIG. 1 is a flowchart of the speech compression process performed in a preferred embodiment of the invention.

An overview of the speech compression process of the preferred embodiment will first be given with reference to FIGS. 1 and 2. A more detailed description of the speech compression system of the preferred embodiment will then be given with reference to FIGS. 3, 4 and 5. FIG. 1 is a flowchart of the speech compression process performed in a preferred embodiment of the invention. It is noted that the flowcharts in the description of the preferred embodiment do not necessarily correspond directly to lines of software code or separate routines and subroutines, but are provided as illustrative of the concepts involved in the relevant process so that one of ordinary skill in the art will best understand how to implement those concepts in the specific configuration and circumstances at hand.

The speech compression method and system described herein may be implemented as software executing on a computer. Alternatively, the speech compression method and system may be implemented in digital circuitry such as one or more integrated circuits designed in accordance with the description of the preferred embodiment. One possible embodiment of the invention includes a polynomial processor designed to perform the polynomial functions which will be described herein, such as the polynomial processor described in "Neural Network and Method of Using Same", having Ser. No. 08/076,601, which is herein incorporated by reference. One of ordinary skill in the art will readily implement the method and system that is most appropriate for the circumstances at hand based on the description herein.

In step 110 of FIG. 1, a speech signal is sampled periodically to form a sequence of speech data. In step 120, the sequence of speech data is segmented into at least one subsequence of segmented speech data, called herein a segment. In a preferred embodiment of the invention, step 120 includes segmenting the sequence of speech data into overlapping segments. Each segment and a sequentially adjacent subsequence of segmented speech data, called herein an adjacent segment, overlap so that both the segment and the adjacent segment include a segment overlap component representing one or more same sampling points of the speech signal. By overlapping each segment and its adjacent segment, a smoother transition between segments is accomplished when the speech signal is reproduced.

Figure 2:
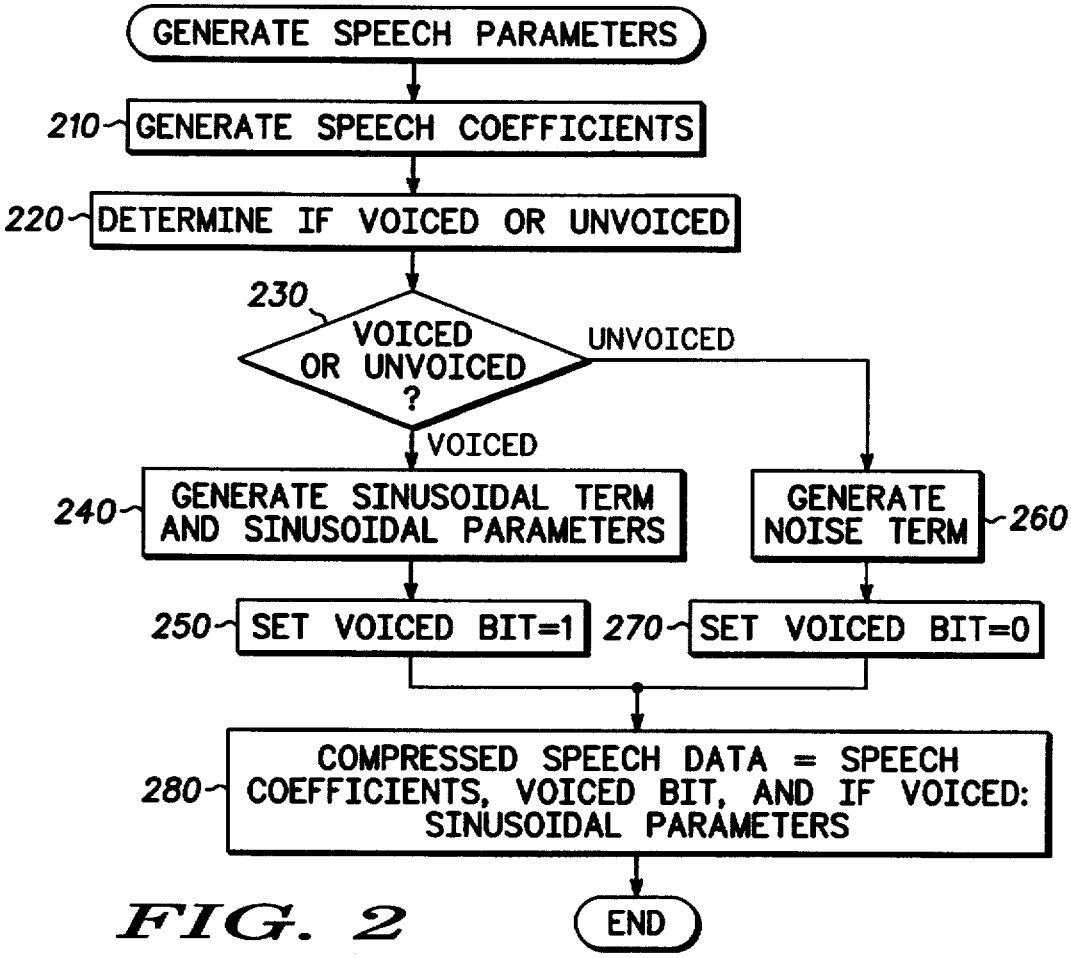
FIG. 2 is a flowchart the speech parameter generation process of the preferred embodiment of the invention.

In step 130, speech parameters are generated for the segment based on the speech data, as described in the flowchart in FIG. 2. In step 210 of FIG. 2, speech coefficients are generated by fitting the segment to a nonlinear predictive coding equation. Preferably, the speech coefficients are generated using a curve-fitting technique such as a least-squares method or a matrix-inversion method. The nonlinear predictive coding equation includes a linear predictive coding equation with linear terms. The nonlinear predictive coding equation further includes at least one cross term that is proportional to a product of two or more of the linear terms. The inclusion of the cross term provides for significantly greater accuracy than the linear predictive coding equation alone. The nonlinear predictive coding equation will be described in detail later in the specification.

In step 220, it is determined whether the speech is voiced or unvoiced. An energy is determined for the segment and compared to an energy threshold. If the energy in the segment is greater than the energy threshold, the segment is determined to be voiced, and steps 240 and 250 are performed. In step 240, sinusoidal parameters are generated for a voiced segment. Specifically, a sinusoidal term is included in the nonlinear predictive coding equation, and a sinusoidal coefficient, an amplitude and a frequency of the sinusoidal term are generated. The sinusoidal term is used for a voiced portion of the speech signal because more accuracy is required in the speech data to represent voiced speech than unvoiced speech. In step 250, an energy flag is generated indicating that the energy is greater than the energy threshold, thus identifying the segment as voiced.

If the energy in the segment is not greater than the energy threshold, the segment is determined to be unvoiced, and steps 260 and 270 are performed. In step 260, a noise term is included in the nonlinear predictive coding equation for an unvoiced segment. The noise term is included because less accuracy is required in the speech data to represent unvoiced speech, and thus greater compression can be realized. In step 270, an energy flag is generated indicating that the energy is not greater than the energy threshold, thus identifying the segment as unvoiced.

Finally, in step 280, the speech coefficients, the energy flag, and the sinusoidal parameters are included as speech parameters in the compressed speech data for the segment. As a result, when the speech signal is reproduced at a later time and the nonlinear predictive coding equation is used to convert the compressed speech data to decompressed speech data, the nonlinear predictive coding equation will include either the sinusoidal term or the noise term, depending on whether the energy flag indicates that the segment is voiced or unvoiced, and the compressed speech data will be converted accordingly. Returning to FIG. 1, In step 140, steps 120 and 130 are repeated for each additional segment as long as the sequence of speech data contains more speech data. When the sequence of speech data contains no more speech data, the process ends.

Figure 3:
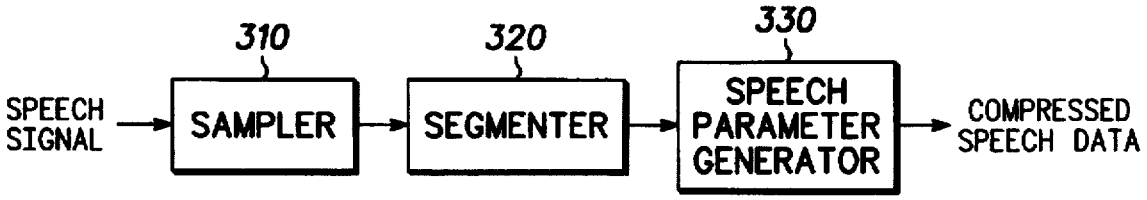
FIG. 3 is a block diagram of the speech compression system of the preferred embodiment of the invention.

FIG. 3 is a block diagram of the speech compression system of the preferred embodiment of the invention. The preferred embodiment may be implemented as a hardware embodiment or a software embodiment as a matter of choice for one of ordinary skill in the art. In a hardware embodiment of the invention, the system of FIG. 3 is implemented as one or more integrated circuits specifically designed to implement the preferred embodiment of the invention as described herein. In one aspect of the hardware embodiment, the integrated circuits include a polynomial processor circuit as described above, designed to perform the polynomial functions of the preferred embodiment of the invention. For example, the polynomial processor is included as part of the speech parameter generator described below. Alternatively, in a software embodiment of the invention, the system of FIG. 3 is implemented as software executing on a computer, in which case the blocks refer to software functions realized in the digital circuitry of the computer.

Initially, a sampler 310 receives the speech signal and samples the speech signal periodically to produce a sequence of speech data. The speech signal is an analog signal which represents actual speech. The speech signal is, for example, an electrical signal produced by a transducer, such as a microphone, which converts the acoustic energy of sound waves produced by the speech to electrical energy. The speech signal may also be produced by speech previously recorded on any appropriate medium. The sampler 310 periodically samples the speech signal at a sampling rate sufficient to accurately represent the speech signal in accordance with the Nyquist theorem. The frequency of detectable speech falls within a range from 100 Hz to 3400 Hz. Accordingly, in an actual embodiment, the speech signal is sampled at a sampling frequency of 8000 Hz. Each sampling produces an 8-bit sampling value representing the amplitude of the speech signal at a corresponding sampling point of the speech signal. The sampling values become part of the sequence of speech data in the order in which they are sampled. The sampler is implemented by, for example, a conventional analog to digital converter. One of ordinary skill in the art will readily implement the sampler 310 as described above.

Figure 4:
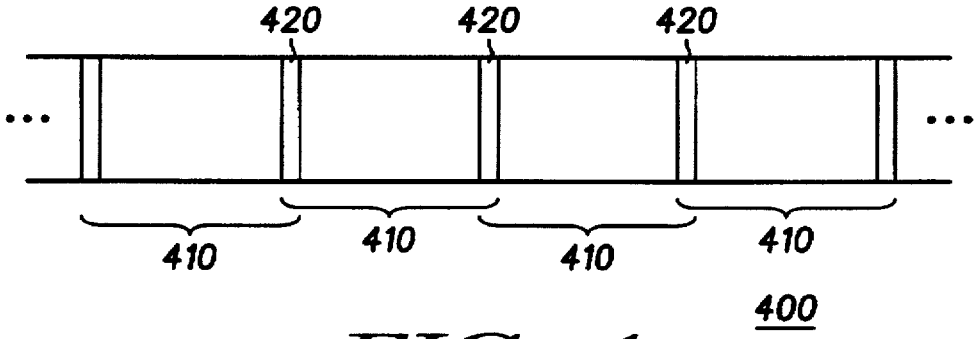
FIG. 4 is an illustration of the sequence of speech data in the preferred embodiment of the invention.

A segmenter 320 receives the sequence of speech data from the sampler 310 and divides the sequence of speech data into segments. Because the preferred embodiment of the invention employs curve-fitting techniques, the speech signal is compressed more efficiently in separate segments. In the preferred embodiment, the segmenter divides the sequence of speech data into overlapping segments as shown in FIG. 4. The sequence of speech data 400 is provided into segments 410. Each segment 410 includes a segment overlap component 420 on each end. In the preferred embodiment, each segment 410 has 164 1-byte sampling values, including 160 sampling values and the 2 segment overlap components 420 on each end, each having 2 sampling values. Because each segment 410 and its adjacent segment share a segment overlap component 420, a smoother transition between segments can be accomplished when the speech signal is reproduced. This is accomplished by averaging the overlap components of each segment and its adjacent segment, and replacing the sampling values with the resulting averages. One of ordinary skill in the art will readily implement the segmenter based on the description herein.

Figure 5:
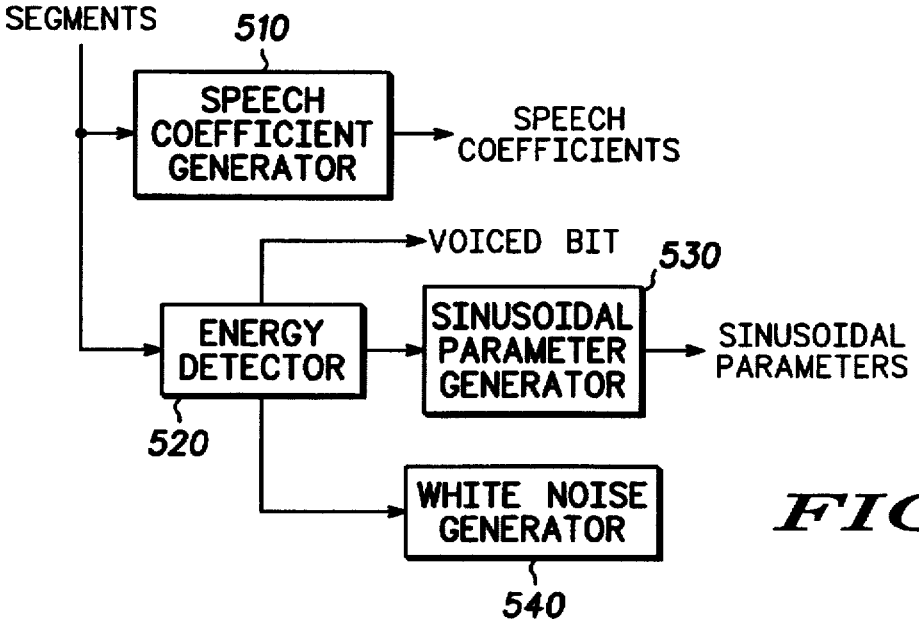
FIG. 5 is a block diagram of the speech parameter generator of the preferred embodiment of the invention.

A speech parameter generator 330 receives the segments from the segmenter 320. The speech parameter generator 330 of the preferred embodiment is described in FIG. 5. In FIG. 5, each segment is received by a speech coefficient generator 510. The speech coefficient generator 510 generates the speech coefficients by fitting the speech data in the segment to a nonlinear predictive coding equation. The speech coefficient generator 510 generates the speech parameters using a curve-fitting technique such as a least-squares method or a matrix-inversion method. The nonlinear predictive coding equation includes a linear predictive coding equation with linear terms. Linear predictive coding is well known to those of ordinary skill in the art, and is described in "Voice Processing", by Gordon E. Pelton, on pp. 52–67 and "Advances in Speech and Audio Compression" by Allen Gersho, Proceedings of the IEEE, Vol. 82, No. 6, Jun. 1994, on pp. 900–918, both of which are hereby incorporated by reference. The nonlinear predictive coding equation further includes at least one cross term that is proportional to a product of two or more of the linear terms.

For example, in a particularly preferred embodiment, the speech coefficient generator 510 generates the speech coefficients by fitting the speech data in the segment to y(k) such that:

$$y(k) = \sum_{i=1}^{n} a_i y(k-i) + a_{n+1} y(k-1) y(k-2)$$

wherein y(k) is the sampling value described above for each sampling point k taken over n past samples y(k–i) and $a_i$ are the speech coefficients. In the nonlinear predictive coding equation above, $\Sigma a_i y(k-i)$ is the linear predictive coding equation and $a_{n+1} y(k-1) y(k-2)$ is the cross term. However, although one possible cross term is illustrated, the cross term could be any product of any number of the linear terms in accordance with the invention described herein. The speech coefficient generator 510 generates the speech coefficients $a_i$ and includes the speech coefficients in the compressed speech data for the segment. For example, the numeric values of the speech coefficients are assigned to a portion of a data structure allocated to contain the speech data. One of ordinary skill in the art will readily implement the speech coefficient generator 510 based on the description herein.

An energy detector 520 determines the energy of the speech signal for the segment by integrating all of the points in the segment, and compares the energy determined, that is, the average value of the integration, to an energy threshold. The energy detector 520 sets an energy flag indicating whether the energy is greater than the energy threshold. Specifically, in the preferred embodiment, the energy detector 520 sets a voiced bit to 1 when the energy determined is greater than the energy threshold, indicating that the segment is voiced. The energy detector 520 sets the voiced bit to 0 when the energy is not greater than the energy threshold, indicating that the segment is unvoiced. For example, an average value of 5 determined in a range of values of ±128 would be interpreted as unvoiced and the voiced bit would be set to zero. One of ordinary skill in the art will recognize that the energy flag could be represented in different ways. The energy detector 520 generates the voiced bit, including the voiced bit in the compressed speech data for the segment.

A sinusoidal parameter generator 530 is invoked by the energy detector 520 when the energy detector 520 determines that the energy is greater than the energy threshold segment. That is, the sinusoidal parameter generator 530 is invoked when the segment is voiced. The sinusoidal parameter generator 530 generates the sinusoidal parameters to be included in the speech data for the voiced segment. The sinusoidal parameter generator 530 includes a sinusoidal term in the nonlinear predictive coding equation such that:

$$y(k) = \sum_{i=1}^{n} a_i y(k-i) + a_{n+1} y(k-1) y(k-2) + b\sin(\omega k/K)$$

wherein b sin(ωk/K) is the sinusoidal term, b is a sinusoidal coefficient of the sinusoidal term (also referred to in the art as gain), ω is a frequency of the sinusoidal term (also referred to in the art as pitch), and K is a constant. Upon decompression of the compressed speech signal, the voiced bit will indicate whether to include the sinusoidal term in the nonlinear predictive coding equation when applying the equation to reproduce the speech data for the segment. The sinusoidal parameter generator 530 generates the sinusoidal coefficient, the amplitude and the frequency of the sinusoidal term as the sinusoidal parameters, and includes the sinusoidal parameters in the compressed speech data for the segment along with the speech coefficients in the manner described above. One of ordinary skill in the art will readily implement the sinusoidal parameter generator 530 based on the description herein.

A white noise generator 540 is invoked by the energy detector 520 when the energy detector 520 determines that the energy is not greater than the energy threshold segment. That is, the white noise generator 540 is invoked when the segment is unvoiced. The white noise generator 540 includes a noise term in the nonlinear predictive coding equation such that:

$$y(k) = \sum_{i=1}^{n} a_i y(k-i) + a_{n+1} y(k-1) y(k-2) + n(k)$$

wherein n(k) is the noise term. For example, n(k) can be represented as cN(k), where c is the energy of the noise, and N(k) is the normalized white noise. Upon decompression of the compressed speech signal, the voiced bit will indicate whether to include the noise term in the nonlinear predictive coding equation when applying the equation to produce the decompressed speech data for the segment. In the preferred embodiment, the noise term is a Gaussian white noise term. However, one of ordinary skill in the art may use other noise models as are appropriate for the objectives of the speech compression system, and will readily implement the white noise generator 540 based on the description herein.

Decompression is essentially the reversal of the compression process described above and will be easily accomplished by one of ordinary skill in the art. For each segment, the speech parameters are converted back into speech data using the nonlinear predictive coding equation for each segment. If the segment is voiced, as determined by the voiced bit, the sinusoidal term has been included in the nonlinear predictive coding equation used to reproduce the speech data. This provides greater accuracy in the speech data for the voiced segment, which requires more description for accurate reproduction of the speech signal than an unvoiced segment. If the segment is unvoiced, as determined by the voiced bit, the noise term has been included in the nonlinear predictive coding equation. This provides a sufficiently accurate model of the speech signal while allowing for greater compression of the speech data.

After the speech data is reproduced, the segment overlap components 420 in each segment 410 are averaged with the segment overlap components 420 in each adjacent segment and the segment overlap components 420 are replaced by the averaged values. This produces a more gradual change in the values of the speech parameters in adjacent segments, and results in a smoother transition between segments such that prior segmentation is not obvious when the speech signal is played back from the decompressed speech data. The segments are aggregated until all of the segments have been aggregated back into a decompressed sequence of speech data. The decompressed sequence of speech data can then be converted to an analog speech signal and played or recorded as desired.

The method and system for compressing a speech signal using nonlinear prediction described above provides the advantage of a more accurate speech compression with a minimal addition of compressed speech data. While specific embodiments of the invention have been shown and described, further modifications and improvements will occur to those skilled in the art. It is understood that this invention is not limited to the particular forms shown and it is intended for the appended claims to cover all modifications of the invention which fall within the true spirit and scope of the invention.

What is claimed is:

1. A method for compressing a speech signal into compressed speech data, the method comprising the steps of:

sampling the speech signal to form a sequence of speech data;

segmenting the sequence of speech data into at least one subsequence of segmented speech data; and generating one or more speech coefficients by fitting a nonlinear predictive coding equation to the subsequence of segmented speech data, the nonlinear predictive coding equation including a linear predictive coding equation having linear terms and the nonlinear predictive coding equation further including at least one cross term that is proportional to a product of two or more of the linear terms, wherein the compressed speech data includes the speech coefficients.

2. The method of claim 1 wherein the step of sampling the speech signal to form a sequence of speech data includes using an analog to digital converter.

3. The method of claim 1 wherein the step of segmenting the sequence of speech data includes segmenting the sequence of speech data into the subsequence of segmented speech data and a sequentially adjacent subsequence of segmented speech data, the subsequence of segmented speech data including a segment overlap component and the sequentially adjacent subsequence of segmented speech data also including the segment overlap component.

4. The method of claim 1 wherein the step of generating the speech coefficients includes using a curve-fitting technique.

5. The method of claim 4 wherein the step of generating the speech coefficients includes a least-squares method.

6. The method of claim 4 wherein the step of generating the speech coefficients includes a matrix-inversion method.

7. The method of claim 1 further comprising the steps of determining an energy in the subsequence of segmented speech data, comparing the energy in the subsequence of segmented speech data to an energy threshold, and including, if the energy in the subsequence of segmented speech data is greater than the energy threshold, a sinusoidal term in the nonlinear predictive coding equation, the sinusoidal term having an amplitude and having a frequency, wherein the compressed speech data further includes a sinusoidal coefficient of the sinusoidal term, the amplitude of the sinusoidal term and the frequency of the sinusoidal term.

8. The method of claim 7 wherein the compressed speech data further includes an energy flag indicating whether the energy is greater than the energy threshold.

9. The method of claim 7 wherein the step of sampling the speech signal to form a sequence of speech data includes using an analog to digital converter.

10. The method of claim 7 wherein the step of segmenting the sequence of speech data includes segmenting the sequence of speech data into the subsequence of segmented speech data and a sequentially adjacent subsequence of segmented speech data, the subsequence of segmented speech data including a segment overlap component and the sequentially adjacent subsequence of segmented speech data also including the segment overlap component.

11. The method of claim 7 wherein the step of generating the speech coefficients includes using a curve-fitting technique.

12. The method of claim 11 wherein the step of generating the speech coefficients includes a least-squares method.

13. The method of claim 11 wherein the step of generating the speech coefficients includes a matrix-inversion method.

14. The method of claim 7, further comprising the step of including, if the energy of the subsequence of segmented speech data is not greater than the energy threshold, a noise term in the nonlinear predictive coding equation.

15. The method of claim 14 wherein the step of including a noise term comprises including a Gaussian noise term.

16. The method of claim 14 wherein the compressed speech data further includes an energy flag indicating whether the energy is greater than the energy threshold.

17. The method of claim 14 wherein the step of sampling the speech signal to form a sequence of speech data includes using of an analog to digital converter.

18. The method of claim 14 wherein the step of segmenting the sequence of speech data includes segmenting the sequence of speech data into the subsequence of segmented speech data and a sequentially adjacent subsequence of segmented speech data, the subsequence of segmented speech data including a segment overlap component and the sequentially adjacent subsequence of segmented speech data also including the segment overlap component.

19. The method of claim 14 wherein the step of generating the speech coefficients includes using a curve-fitting technique.

20. The method of claim 19 wherein the step of generating the speech coefficients includes a least-squares method.

21. The method of claim 19 wherein the step of generating the speech coefficients includes a matrix-inversion method.

22. A system for compressing a speech signal into compressed speech data, the system comprising:

a sampler for sampling the speech signal to form a sequence of speech data;

a segmenter, coupled to the sampler, for segmenting the sequence of speech data into at least one subsequence of segmented speech data; and a speech coefficient generator, coupled to the segmenter, for generating one or more speech coefficients by fitting a nonlinear predictive coding equation to the subsequence of segmented speech data, the nonlinear predictive coding equation including a linear predictive coding equation having linear terms and the nonlinear predictive coding equation further including at least one cross term that is proportional to a product of two or more of the linear terms, wherein the compressed speech data includes the speech coefficients.

23. The system of claim 22 wherein the sampler includes an analog to digital converter.

24. The system of claim 22 wherein the segmenter segments the sequence of speech data into the subsequence of segmented speech data and a sequentially adjacent subsequence of segmented speech data, the subsequence of segmented speech data including a segment overlap component and the sequentially adjacent subsequence of segmented speech data also including the segment overlap component.

25. The system of claim 22 wherein the speech coefficient generator utilizes a curve-fitting technique.

26. The system of claim 25 wherein the speech coefficient generator utilizes a least-squares method.

27. The system of claim 25 wherein the speech coefficient generator utilizes a matrix-inversion method.

28. The system of claim 22, further comprising an energy detector for determining an energy in the subsequence of segmented speech data and comparing the energy in the subsequence of segmented speech data to an energy threshold, and a sinusoidal parameter generator, coupled to the energy detector, for including, if the energy in the subsequence of segmented speech data is greater than the energy threshold, a sinusoidal term in the nonlinear predictive coding equation, the sinusoidal term having an amplitude and having a frequency, wherein the compressed speech data further includes a sinusoidal coefficient of the sinusoidal term, the amplitude of the sinusoidal term and the frequency of the sinusoidal term.

29. The system of claim 28 wherein the compressed speech data further includes an energy flag indicating whether the energy is greater than the energy threshold.

30. The system of claim 28, further comprising a white noise generator, coupled to the energy detector, for including, if the energy in the subsequence of segmented speech data is not greater than the energy threshold, a noise term in the nonlinear predictive coding equation.

31. The system of claim 30 wherein the compressed speech data further includes an energy flag indicating whether the energy is greater than the energy threshold.

* * * * *